US006212913B1

(12) United States Patent
Weiss

(10) Patent No.: US 6,212,913 B1
(45) Date of Patent: Apr. 10, 2001

(54) MANUFACTURE OF ROLLER-BLINDS

(76) Inventor: Albert Weiss, Schillierstrasse 9, D-74747 Ravenstein (DE)

( * ) Notice: Subject to any disclaimer, the term of this patent is extended or adjusted under 35 U.S.C. 154(b) by 0 days.

(21) Appl. No.: 09/267,819

(22) Filed: Mar. 12, 1999

(30) Foreign Application Priority Data

Mar. 13, 1998 (DE) ..... 198 10 971
Aug. 12, 1998 (DE) ..... 198 36 447

(51) Int. Cl.[7] ..... D03D 3/00
(52) U.S. Cl. ..... 66/172 R; 139/389
(58) Field of Search ..... 66/147, 172 R; 139/389

(56) References Cited

U.S. PATENT DOCUMENTS 1,423,524 * 7/1922 Hill et al. ..... 139/389
1,749,734 * 3/1930 Kelly ..... 139/389
3,470,928 * 10/1969 Schwartz ..... 139/389
3,656,323 * 4/1972 Brown ..... 66/177
3,945,096 * 3/1976 Miranker ..... 66/147
4,033,151 * 7/1977 Jansen ..... 66/147
5,791,392 * 8/1998 Fernandez Lopez ..... 160/238

* cited by examiner

*Primary Examiner*—Andy Falik
(74) *Attorney, Agent, or Firm*—Dority & Manning

(57) ABSTRACT

A process for producing roller blinds includes defining a plurality of shapes for the completed roller blind in a continuous material band. The band has a uniform width and edges of the roller blind are defined between the longitudinal edges of the material band. Separating strips are defined in the material band between adjacent edges of the devices. The individual devices are removed from the continuous material band by separating the material band along the separating strips.

26 Claims, 5 Drawing Sheets

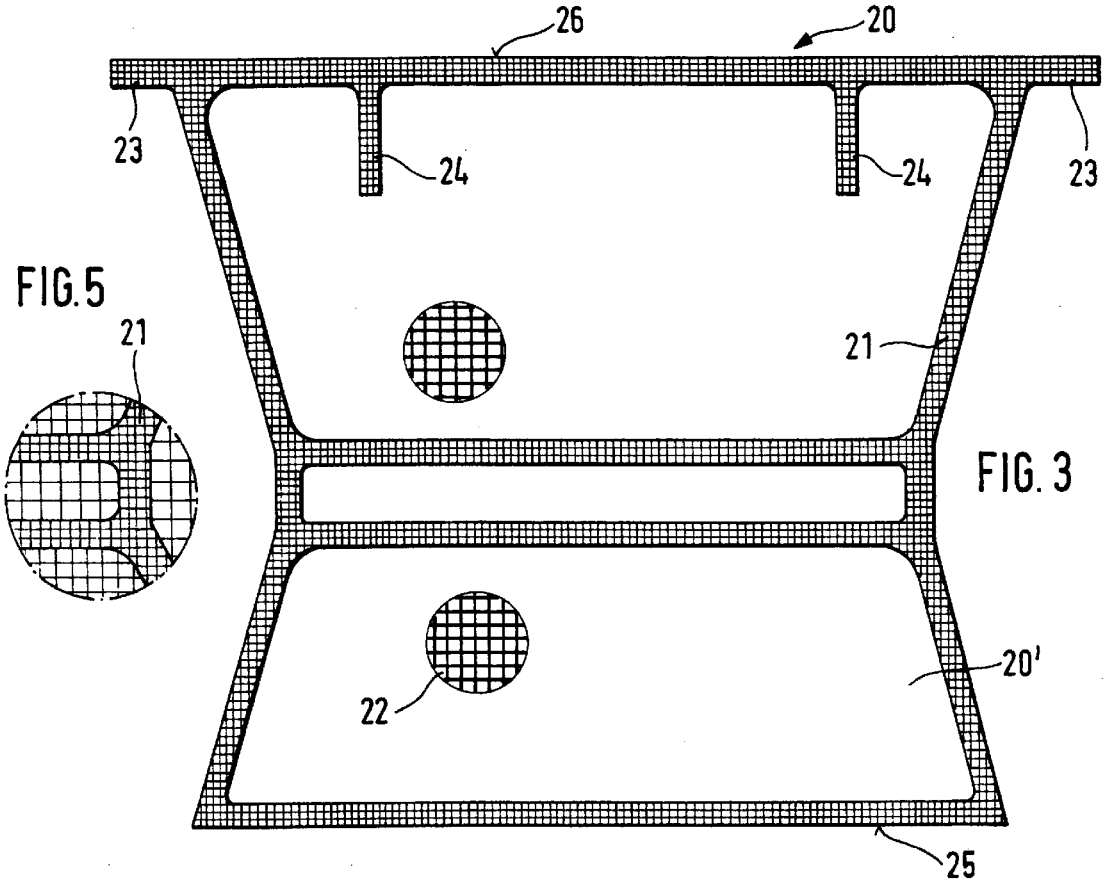
FIG. 5
FIG. 3
FIG. 4
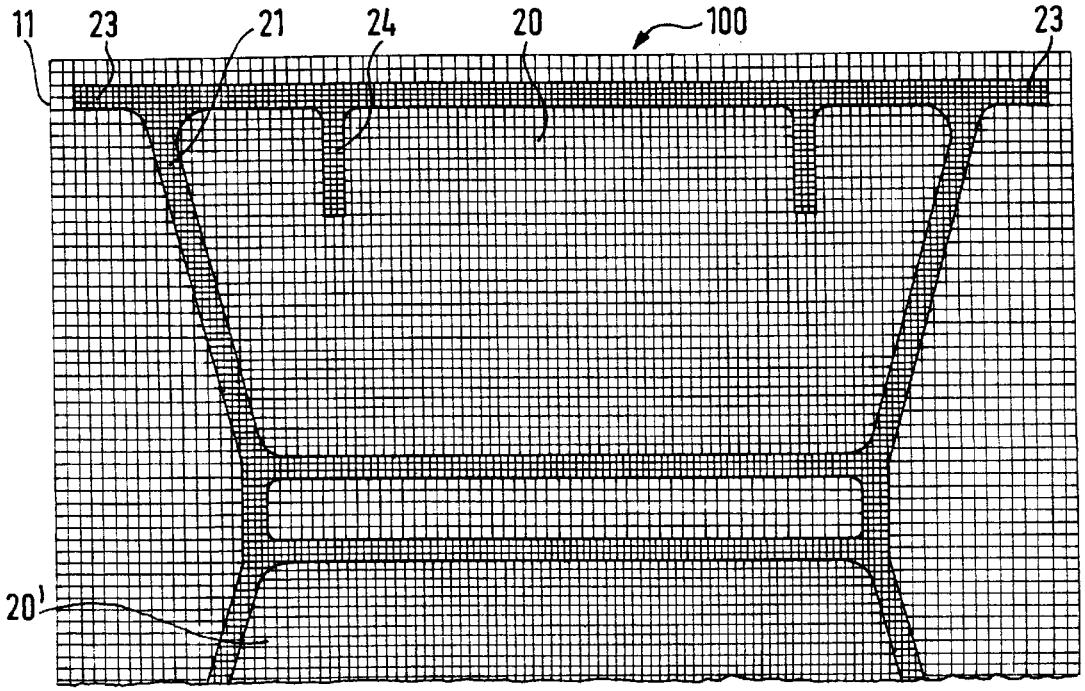

MANUFACTURE OF ROLLER-BLINDS

BACKGROUND OF THE INVENTION

The invention is concerned with a process for the manufacture of roller-blinds, jalousies, safety nets, separation nets and the like, especially as applied to motor vehicles.

The manufacture of the finished article is usually carried out in such a manner, that the necessary fabric blanks required for the roller-blinds or jalousies are cut out of a master sheet and are then custom fabricated. It is necessary that the roller-blinds are furnished with a firm edging, but not so firm as to interfere with the winding operation. On this account, conventional roller-blinds were usually simply cut from a master material band, which was already trimmed to the desired width of the roller-blind. A difficulty in this is that for the various widths of windows, a plurality of different master sheets must be made. Furthermore, this means that because the full width of the fabric manufacturing machine is not fully utilized, the fabric edge, which is made by the production of the master sheet, is indeed firm, yet generally not suitable for the edge of a roller-blind. This is because the edge is damaged by needle puncture or clamping during production, impaired by subsequent additions or coatings, or may even be deformed out of line.

In the case of roller-blinds for motor vehicle windows, an additional problem arises in that non-rectangularly shaped windows must be fitted. A mass produced edge does not permit itself to be applied to windows for vehicles. These roller-blinds were, therefore, in the course of manufacture, adapted to the required edges by sewing on the necessary periphery or binding around it. This process is a very expensive step in manufacture.

Beyond this, the reinforced borders form bulges on the edges when rolled up, so that for the more thickened winding diameter, more space is required. A further danger is that the master sheet does not wind up uniformly and is distorted.

The effort has been made, to "weld" these edges, which required the use of polyvinyl chloride (PVC). PVC should no longer be used, because of the dangerous vapor developed therefrom upon burning (producing, among other things, dioxin). Another attempt has been made to substitute in this connection the better suited polyurethane, however, problems arose in weldability.

A further problem arose in the application of internal rods which were used for the stiffening of the beginning edge of the roller-blind and which serve also for activation or as a support for horizontal evenness. So called "pockets" were sewn into the master sheet, in which the rods could be inserted. This addition to the manufacture of the roller-blinds is extremely expensive. Further efforts included, in the case of layered master sheets, making such pockets by adhesives or again welding. Even this solution to the problem is very labor intensive, not to mention, that it is scarcely appropriate in its appearance.

OBJECTS AND SUMMARY OF THE INVENTION

It is a principal object of the present invention to produce roller-blinds for the multiplicity of window and section shapes of vehicles in the proper form, so that a separate custom cutting becomes superfluous. A further object in accordance with the invention is that the roller-blinds are already, at their time of manufacture, so complete that a special fabrication for this purpose is superfluous. In regard to the term "roller-blinds", it is to be understood all rollable or gathered sheet material, which finds use as netting, closure of textile surfacing, as well as one or two sided lamination application. Additional objects and advantages of the invention will be set forth in part in the following description, or may be obvious from the description, or may be learned through practice of the invention.

The purposes will be achieved, in accord with the invention, through the features of a process for the production of roller blinds, jalousies, safety, or separation etc. The individual material is produced in a continuous band of uniform width. The running course of the band can be manipulated in a customary manner for production and further, in the case of additional processes such as coating, operates without problems. Otherwise, the material pieces correspond to the desired roller-blind shape with a corresponding rigid material edge, the latter being made during the manufacture of the material band.

By means of provided partitioning strips or separating rows, the individual material pieces can be removed from the running machine in a simple manner. The edge zone of the material pieces can be worked into a firm border by binding, as well as being reinforced, to enable the rods/struts to be inserted.

For the insertion of the rods or guides into the roller-blind surface, extending over the width and/or the length of the material piece, tubular-like pockets can be provided, which are worked in at the time of the production of the material band. Eyelets for the fastening of the holding means likewise can be worked into the edge of the material band during its manufacture.

The advantages of this method of production are immediately evident, in that complex custom making is dispensed with. Also, there arises no, or at least unimportant, thickening in the border region, whereby the roller-blind winds up without difficulty and with essentially lesser space requirements than is normally required for conventional roller-blinds. There is also shown, appearance-wise, a cleaner cut-off at the edges. Color differences are done away with, which otherwise appear necessarily on the edges by the inclusion of different materials for the fabrication of the roller-blind or the network.

Through the prolonging of the firm or reinforced side edges, fastening bands are already at hand and need not be sewed on. In particular, in the case of netting, no distortion of the net structure occurs with the netting during the fabrication of the final element. The corners can be shaped with an optional radius, without cutting losses such as are caused by trimming the edges when custom made. The individual parts are produced with substantially closer tolerances in the dimensioning.

Further details of the invention can be made evident with the help of the drawings.

BRIEF DESCRIPTION OF THE DRAWINGS

FIG. 3 shows a true-to-form, produced finished article, which has been taken off the production belt, in accord with FIG. 4;

FIG. 4 shows the finished article in accord with FIG. 3, as it was produced on the production band;

FIG. 5 shows a detail of FIG. 4;

DETAILED DESCRIPTION

Figure 1:
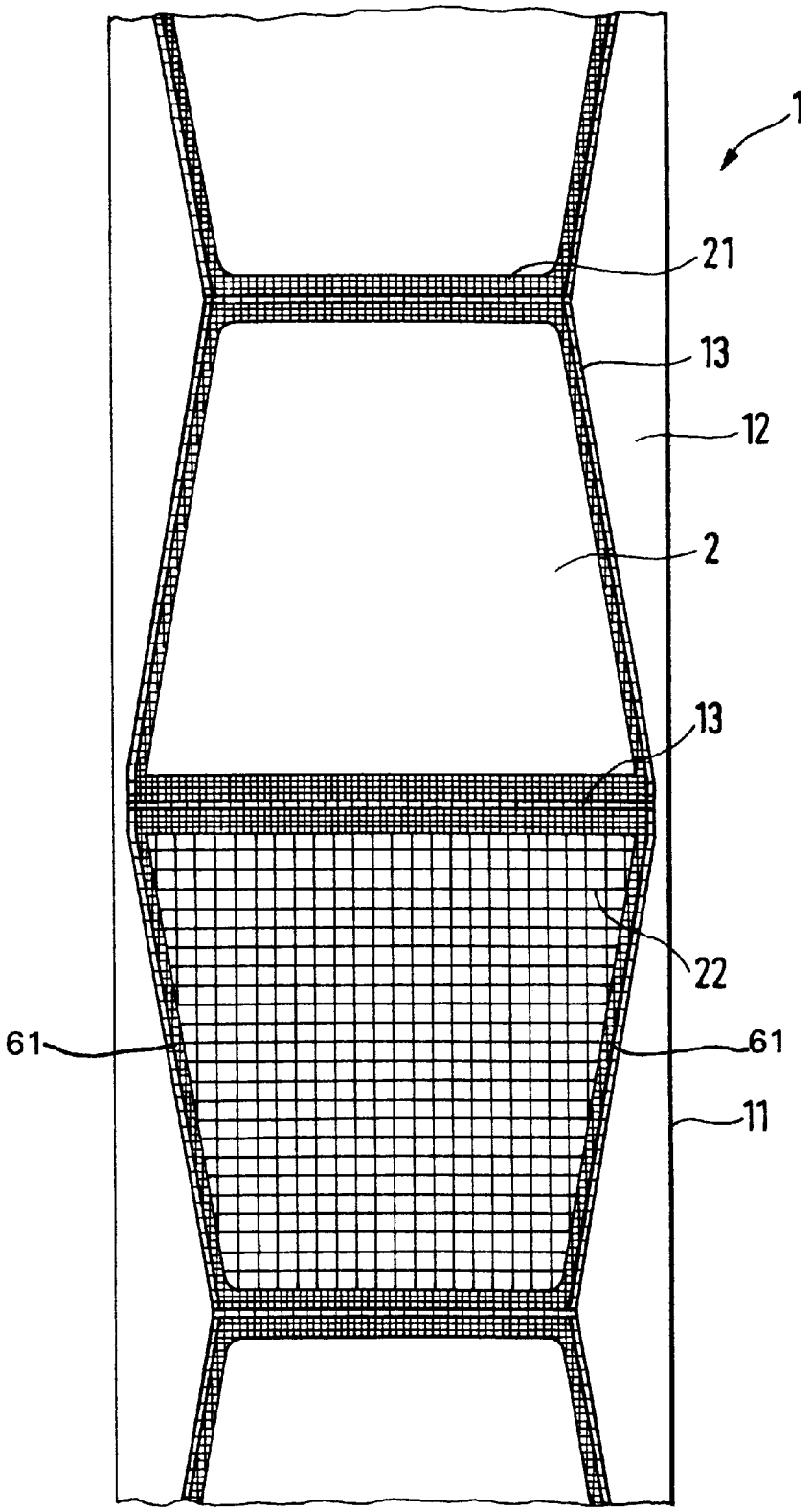
FIG. 1 shows a running strip of material of uniform width with true-to-form produced finished articles.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations.

The material band 1 in accord with FIG. 1 is a continuously produced band of material of uniform width. The band exhibits a production edge 11 on each side, which is made during the manufacturing process and which is firm enough to be tensioned and run through needling, gripping, or clamping or other equipment associated with production.

If a weaving machine is being used to make the material, obviously woven ware is produced. In this case, the warp threads run in the longitudinal direction of the material band while the weft threads run at right angles to the warp threads over the width of the material band 1.

For instance, in the case of weaving the production edging 11 is made by the reversal of the weft threading.

If the material band 1 is set up on a knitting machine, for instance a Raschel machine, then the warp threading is in the longitudinal direction of the material band 1. However, the warp threads, according to the patterning movement of the eye-pointed needles, are bound together and designed into a net making system. The eye-point needles are affixed to the guide bars and serve as knitting needles arranged in a needle bar. It is possible that weft threads can be brought in at cross direction to the network formed by the warp threading. Even in this case, a firm production edge 11 is made by the reverse motion of the guide rails on the edge of the article and the so formed edge netting.

The finished articles, in accord with the invention, can be made just as well on weaving machines as on knitting machines, according to which kind of finished articles are desired.

The binding techniques of the weaving machines as well as those of the knitting machines, and the materials which may be manufactured therewith are well known, so that a description of the same would be superfluous. Advantageously, synthetic thread material is employed in either endless form or as fiber yarn.

As FIG. 1 shows, the finished articles 2 are produced in row form; one after another in the material band. Between the finished article 2 and the production edge 11 is the edge zone 12 of the material band 1. The band is partitioned by a separation strip 13 from the finished article 2. Also, between the individual finished articles 2 is another separation strip 13, in order to be able to individually take off said articles.

The separation strips 13 seam the finished article 2, which is encompassed by a reinforced edge 21, so that the shape of the finished article 2 is fully developed.

If the material band 1 is produced on the machine, and the subsequent additional process is ended, then, by a cutting tool which follows the separating strips, the single finished articles 2 are cut away from the material band 1 and thus individually removed.

Since the separating strips 13 are defined during the production of the material band 1, the finished article is complete in its shape even as the material is being manufactured. By means of the reinforced edge 21, the finished article 2 also simultaneously receives an edge, which is made fast in such a manner that the edge is clean cut and not frayed after its removal from the material band.

In order to make the finished article 2 stable and to prevent the pulling out of threads along the edge area, its edge 21 is worked up as a rim of some solidarity. This can be done either by working in a reinforcement or also by an appropriate thread binding. Reinforcement is mostly carried out by additional threads or double threads in weft or warp directions, in accordance with which edge is to be reinforced. If, in this connection, the work is with synthetic threads which exhibit a lower melting point than that of the threads used for the finished article 2, then a reinforcement of the edge 21 can be achieved, in that these additive or strengthening threads can be melted by heat treatment, so that a sealing of this edge 21 is accomplished.

The surface 22 encompassed by the reinforced edge 21 of the finished article 2 is shown in the embodiment of FIG. 1 as a net. However, if the use of the finished article 2 is to be as a roller-blind or jalousie for the back windows in motor vehicles, then the surface 22 need not be a wide meshed net, but be made as a closed surface. In the case of rear roller-blinds, the surface 22 is worked up as a fine and relatively closed mesh in order to guard against sunshine. On the other hand, a perforated surface must be at least about 35 to 60% open for visibility therethrough. Weighing these requirements, this surface 22 will be formulated by the application of appropriate binding technologies. Since the binding techniques are known, a detailed description thereof would be superfluous.

Instead of a separation strip 13 between the single, sequential finished articles, it is possible to have also a separation row provided. This row is known from knitting machines. The cross over rows are bound together in such a manner that, by the pulling out of one thread running in the weft direction, the connection of the two finished articles 2 is broken.

Figure 2:
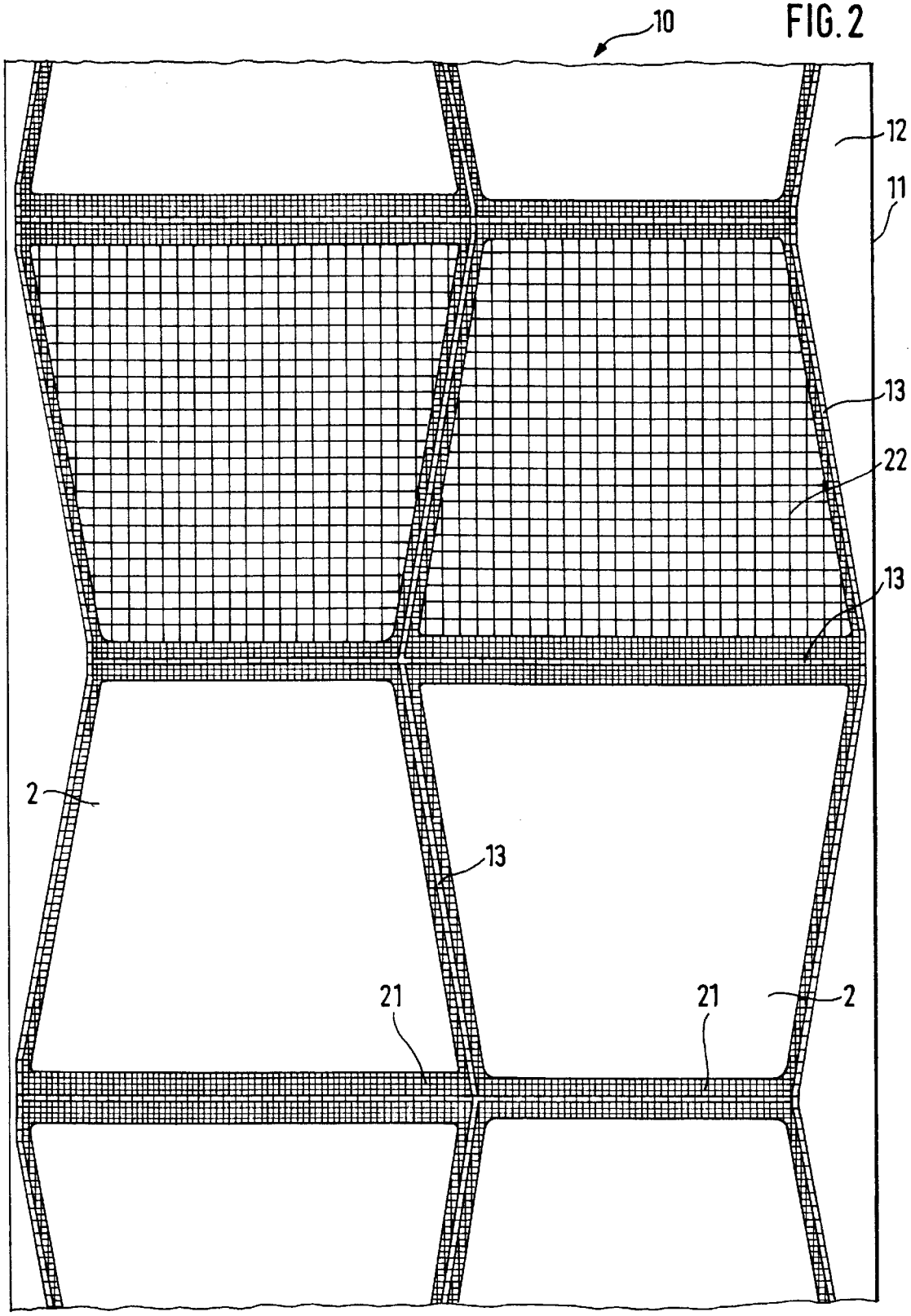
FIG. 2 shows another running strip of material, in which a plurality of rows of the finished articles are situated within the article track.

In the case of warp machines, the separation lines run longitudinally, so that upon the pulling out of the so-called "pull threads", the finished article 2 is separated from neighboring finished articles 2 or from the edge zone 12 of the material band 1 or 10 (FIG. 2). Cutting is not required in this operation.

Since, dependent on the binding, the extraction of the separating thread is not always problem free, a separating thread can also be used which performs its action through a corresponding after treatment. Thereby, the desired separation of the finished products 2, 20, 3, and 30 from the edge zone 12 is achieved. For instance, cotton yarn is an apt material for this purpose, since it can be dissolved later by sulfuric acid. Advantageously, however, a polyvinyl alcohol yarn (PVA) can be used, which can easily be washed out by warm water. This so-called "burn-out" technique is known in another connection, so that, again, a detailed description is superfluous.

FIG. 3 shows as a finished article 20, for instance, a safety net separated out of the material band 100, in accord with FIG. 4. For instance, these safety nets can be used for the separation of the loading space from the passenger space in van type motor vehicles. The net 20 is produced true-to-form in the material band 100 and subsequently separated away from this material band 100. The surface of the net 20 is encompassed, in this instance, by a rim 21 reinforced by reinforcement. In the case of the reinforcement of the upper edge 26 of the finished article 20, in the continuation of the edge 21 of the finished article 20, fastening ribbons 23 have been worked in. The under part 20' of the finished article 20 serves as the fastening. For this purpose, the under part 20' is folded around a corresponding rod suitably arranged in the vehicle, whereby the reinforced lower net edge 25 is fastened to the reinforcements 24 and onto the net edge 21 with suitable means.

The worked in reinforcements 24 in the material surface 22, designed as network structure, serve for the fastening of holding means such as clip-on buttons, eyelets, and the like. Eyelets of this kind for the fastening of holding means or for engaging holding means can also be worked directly into the edge 21 of the finished article 2 and 20.

In order to design the edge 21 of the finished article 2 and 20 with the greatest possible stability and wear resistance, this edge can just as well have thread binding to make a firm edge, as well as being additionally reinforced.

Although the finished articles 2 and 20, as described up to now, have had a net-like character, the invention can be advantageously applied to closed, i.e., non-netlike article surfacing. These product surfaces are mostly coated, whereby the textile structure of the material band manufacture is mostly covered, so that the worked-up form of the material band having separating strips is scarcely visible. In this case, the working in of the outer edge shape of the finished article makes little sense, especially on the account, that because of the coating, the cut edges do not fray. Here arises another kind of the true-to-form manufacture, in accord with the invention, which will be described in the following. Roller-blinds of this kind are especially well adapted for installation in the inside covering of sliding roof apertures and the like of motor vehicles.

According to the described conventional method of manufacture, employed up to now, for the reception of the rods, pockets were custom made or attached by adhesives. Whereby, for the adhesion, principally PVC materials were preferred. By means of the process of the present invention, this exceptionally time and expense consuming method of production could be avoided. The pockets for the rods were already worked into the material band. These pockets extended crossways over the surface of the material. The metal of this rod is not visible, but is fully enclosed, so that a smooth, uninterrupted roof liner is shown in the passenger space. By means of this coating and the method of working, the roller-blinds also fit in with the furnishings of the vehicle interior.

Figure 6:
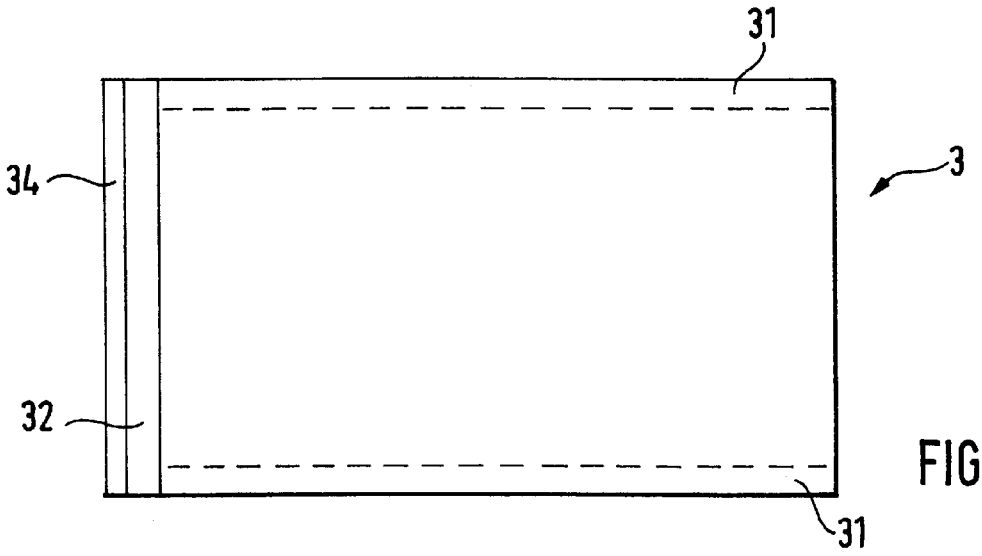
FIG. 6 shows a finished article with a tubular edging.

FIG. 6 shows such a finished article 3, rectangular in its outer shape, which possesses on its forward edge a tube-like pocket 32 for the acceptance of the rod. In order to protect the pocket 32 against tearing by tension stress, a safety edge 34 follows a safety edge 34 along the pocket 32.

Figure 7:
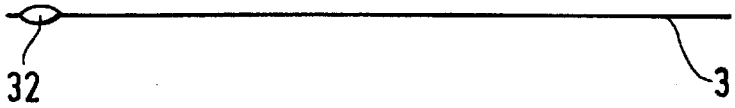
FIG. 7 shows a longitudinal section of FIG. 6.

Further, the two side edges 31 are reinforced and also made firm, wherein the strengthening by working-in reinforcement thread and/or binding of the thread can be carried out. FIG. 7 shows the finished article 3 from FIG. 6 in a longitudinal side view. In this case, the pocket is formed as a true-to-form tube and is not created by turning over the forward edge and custom sewing. Pockets of this kind, made directly in the material band itself and not folded over, show much less bulkiness and make a much more organically integrated fabric surface.

The manufacturing of this particular embodiment is done in the same manner as already described above. A plurality of such finished articles 3 or roller blind device are made dimensionally correct one after the other, in a material band of uniform width. Subsequently, the articles are separated out of the material band in accordance with the present invention. The individual finished articles 3 can be separated from the edge zone 12 of the material band 1, 10 by means of separation strips 13. The finished article 3 advantageously starts with the safety edge 34 after which the tube-like pocket 32 follows. The finished article 3 ends with a separating strip 13, at which point the next finished article 3 follows in the same manner. The finished article 3 shown in FIGS. 6 and 7 is already finished and cut off from the material band.

Fundamentally, finished article 3 can also be laid out in a reverse direction, with the separation strip followed by the smooth surface of the finished article first. Thereafter, the tube pocket 32 follows and, if required, ends with the safety edge 34. This safety edge 34 has a width of, for example, 3 to 5 mm and should generally be broad enough to reinforce the pocket binding even under load conditions and prevent tearing of the pocket binding. On this end, the separating strip will follow and the next finished article will begin, as has been described.

Figure 8:
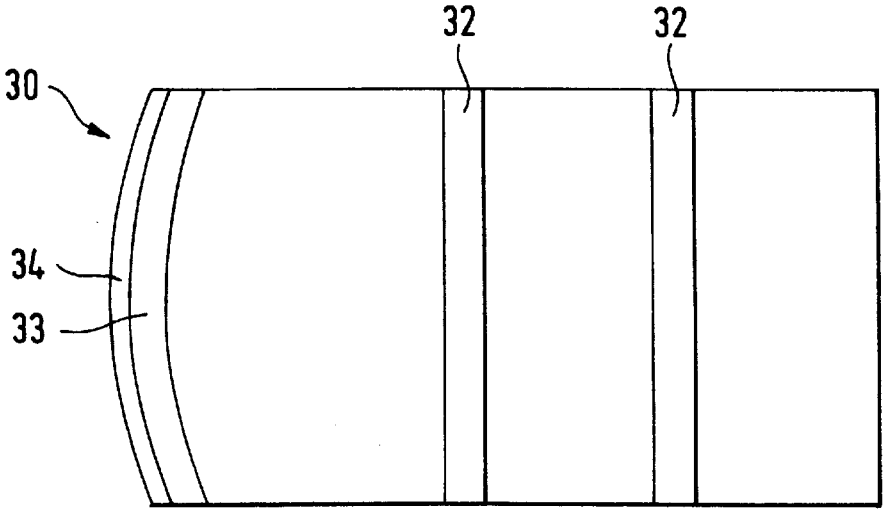
FIG. 8 shows a finished article with straight and curved, tube-like rod pockets.

In FIG. 8, a similar finished article is shown. However, in this case, the rod pocket exhibits here a curvature at the beginning of the finished article 30.

Figure 9:
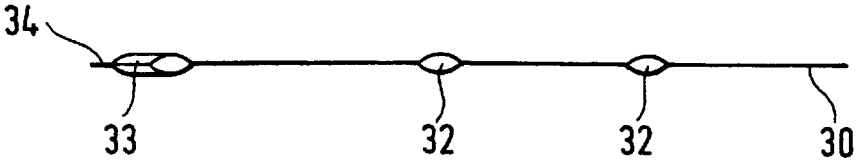
FIG. 9 shows a longitudinal section of FIG. 9.

This curved rod pocket 33 is also made true-to-form in a material band of uniform width. Such a finished article finds application as a slide roof ("sun roof" curtain) wherein the forward part with the rod pocket fits into the curvature of the windshield section. For greater extensions of such sun roof openings, it proves practical to stiffen the sun roof curtains or undertake the fabrication of rods 32 corresponding to the arch of the vehicle roof liner. FIG. 9 shows a longitudinal section through the sun roof curtain from FIG. 8.

Figure 10:
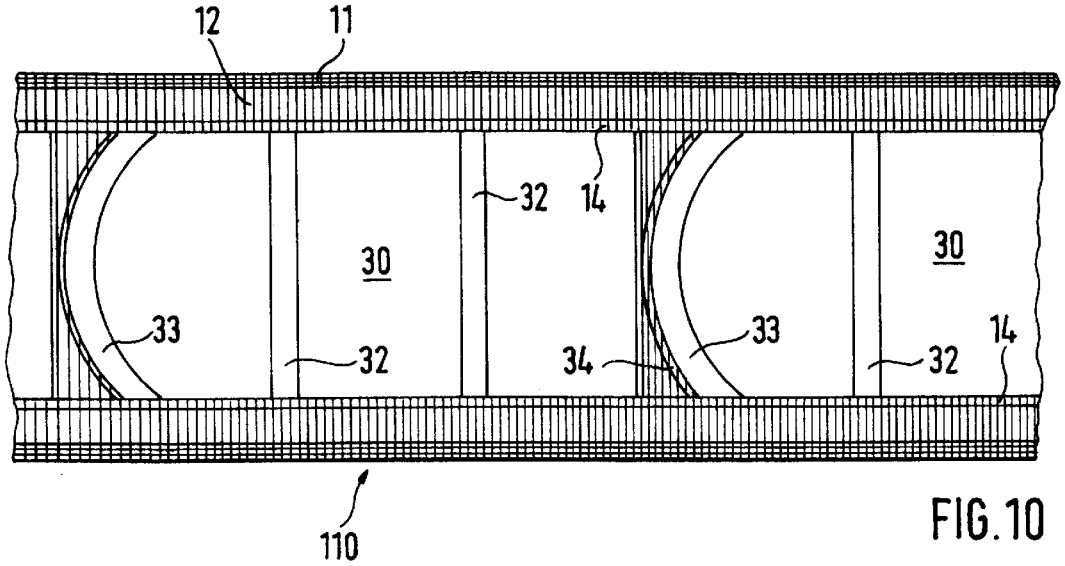
FIG. 10 shows a production band of material in accord with FIG. 8.

Also these finished articles 30 are manufactured true-to-form in a material band 110 (see FIG. 10). The material band 110 exhibits a production edge 11, an edge zone 12 as well as separation strips 14, in order to remove the finished articles one by one. Where warp knit ware is concerned, the separating strips 14 can be implanted, in order to separate the finished articles 30 from the edge zone 12 of the material band by means of the pulling out or the releasing of a thread. A cutting tool is not required for this purpose.

If the textile material band is to be subsequently coated, then the separation strip 13 or the separation row 14 will be generally joined adhesively by means of the coating. As has been mentioned above, the working-in of the separation rows 14 or the separating strips 13 becomes superfluous. After the coating process, the usual cutting for the separation of the individual finished articles along the sides and along the safety edges 34 follows. Upon coating, care must be taken that the pockets 32 and 33 of the finished product 3 and 30 that are worked in during the manufacture of the textile band 100 and 110 are not closed by adhesive. Apart from the fact that it is necessary to adjust the viscosity of the coating means so that it does not penetrate through the textile band, it is also necessary to take measures to ensure that the textile band to be coated is, at least in the area of the pockets 32 and 33, sufficiently thick. This can be effected in various ways. It has proven valuable to heat press the textile band to about 210° C., at least in the area of the pockets. In this way, the threads are, in effect, made thicker, so that no coating material penetrates.

Also, the application of textured thread material or fiber yarn for the creation of the textile band to be coated has proven itself in service. Both measures can, for safety's sake, also be combined.

The pockets 32 and 33 described up until now are so worked that the both pocket sides are formed as part of the material band. Upon weaving, this is done in such a manner that respectively the half of the warp for each pocket side is pulled in and, at the end of the pocket, the warp threads are again brought together, so that the textile band continues on with 100% of the warp threads. This method of production is mostly used for roller-blinds which must have an exposed surface on both sides.

Figure 12:
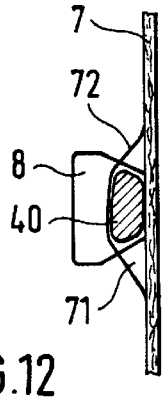
FIGS. 11 & 12 shows a detailed example of a worked in rod pocket in top view and section.
Figure 11:
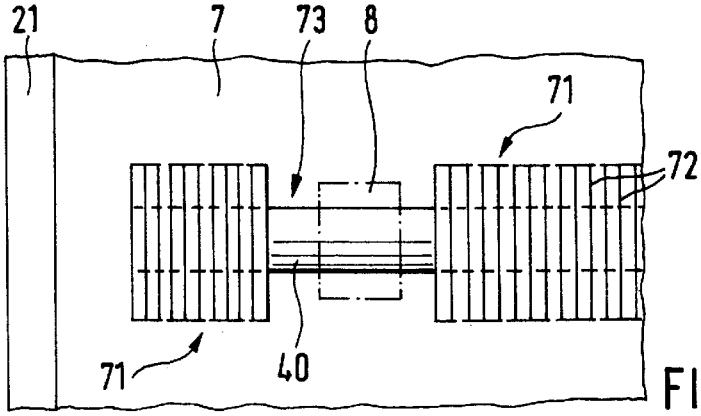

FIG. 11 and 12 show another kind of the production method for the rod pockets. The finished article 7 exhibits a reinforced and thereby firmed-up edge 21. Only that part of the finished article 7 is shown in which a pocket 71 has been worked in. As may be inferred from FIG. 12, the finished article 7 is throughly processed. However, in the area of the pocket 71, a part of the warp threads 72 in the pocket area have been removed from the warp of the finished article 7. The warp threads remaining in the article surface are bound with 100% weft inserts, while the removed threads 72 remain without a weft combination. These remaining warp threads in a non-visible area of the finished article form the one side of the pocket 71 into which the rod 40 may be inserted and so held. As is obvious from FIG. 11, the pocket 71 possesses an interruption 73 so that clips 8 are able to reach through. These clips 8 serve for retaining and guiding the rod 40 and thereby also the curtain itself within corresponding guide rails on the roof lining of the vehicle. The rod 40 and also the pocket 71 end before the reinforced edge 21 and thus do not extend themselves over the total width of the finished article. The finished article 7 is only designed as an exposed surface for the covering, for instance, of a sun roof aperture. That part of the article 7 which remains extended beyond the material pocket, serves for the covering of the section edge in the vehicle roof liner.

In order to be able to make the curtain fit the cross arching of the roof, the pocket 71 can possess a plurality of interruptions 73 for the penetration of the clips 8 or other securing means for the rods 40. In order to change the structural surface of the exposed side of the finished article 7 as little as possible, only as many warp threads 72 are removed from the surface of the finished article as are necessary to secure the rod safely. In the interruption 73 of the pocket 71 as well as in the edge zone 21, which is not reached by the pocket 71, all warp threads remain in the surface of the finished article 7.

Figure 13:
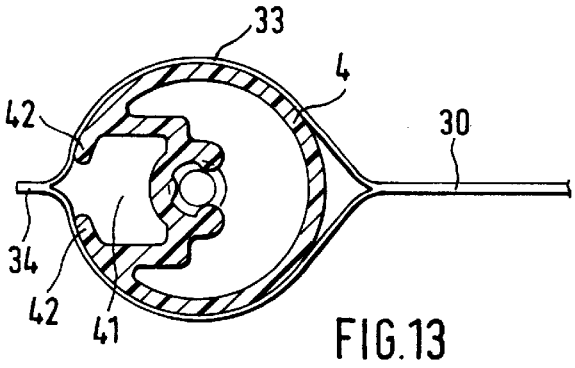
FIGS. 13 & 14 shows a front pocket with inserted and affixed front rod in accord with the invention.

After the individualization of the finished article, the curtain is completed by the insertion of the rods into the pockets 32 and 33. In a preferred embodiment, the rod 4 for the front pocket 32 and 33 is particularly constructed. As may be seen in FIG. 13, this rod 4 is provided with a recessed cove 41, which runs axially along its front side. If the rod 4 is inserted into the pocket 33, then the safety edge 34 is pressed into this cavity 41, whereby the pocket 33 is also partially drawn in and brought to a tension about the said curtain rod 4. A safety part 5 is also pressed into this cavity and covers the same, whereby the safety part 5 is held therein tightly with a twine cord or a rubber gasketing 6. Simultaneously, the safety edge 34 is made invisible. The cavity 41 exhibits on its entry side, two elastic projections 42, which flexibly clamp in the safety part 5, which simultaneously with the safety edge, has also pulled material into the concavity of said cavity 41.

Figure 14:
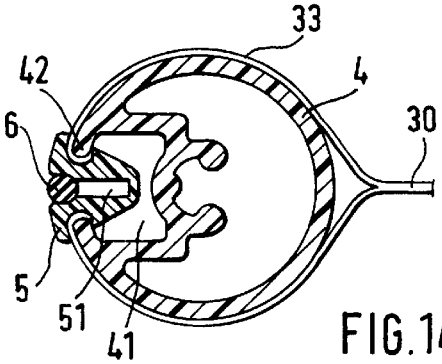

This kind of fastening of the front rod 4 can be done in straight shape (FIG. 6) or in bowed shape (FIG. 8). This safety part 5 is preferably a plastic part and extends itself (see FIG. 14) mushroom like over the entry to the said concavity of the cavity 41 on both sides. There is a central recess 51 by means of which an expansion compression is made possible upon insertions into the cavity 41. In order to hold securely the safety part 5 in its clamping tension, an expansion means 6 is pressed into the central recess 51. The safety part 5 also has also the special protective function of avoiding an abrasion or perforation through the pocket 33 on the front side.

The described embodiments are only examples and can, obviously, be combined in various ways. Thus, a finished article can also be produced, even in such a way that a front pocket, in accord with FIGS. 11 and 12 were produced. Pockets, as shown in the FIGS. 6 to 12 and as described, can also be incorporated in finished articles such as have been described in FIGS. 1 to 5. The surfaces of the articles can be closed or networked, or provided with exposed finish on one or both sides. The profiling of the finished articles can be done within the limits in the edge zone 12 or in the pockets 32, 33 for the reception of rods 4.

As described above, the stiffening and/or reinforcement of the edge 21 as well as the thread binding can be done by means of strengthening threads. In addition, the so-called adhesive threading can be applied, which have a lower melting point than the rest of the thread material. By a corresponding heat treatment, these threads melt and cause adherence in the edge 21 and 31, so that, after the separation through cutting or removing a separating thread, these edge cannot fray. The adhesive threads can be brought in as well as reinforcement threads. Also, a plied yarn comprising normal threads and one or more adhesive threads can be applied to this edge.

The latter has the advantage that the edge 21 is not carried off as an edge in the finish article and is thus not differentiated from the textile surface. The plied yarn in this matter can be so brought to suitability by observing the yarn number, so that after the melting of the adhesive threads, no visible difference is recognizable.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A process for producing roller blind devices, comprising: providing a continuous material band having a uniform width defining a plurality of shapes for the roller blind devices in said continuous material band having a uniform width by defining edges of the roller blind devices between longitudinal edge areas of the material band; providing separating strips in the material band between adjacent edges of the roller blind devices; and removing the individual roller blind devices from the continuous material band by separating the material band along the separating strips.

2. The process as in claim 1, wherein the plurality of shapes for the completed roller blind devices are defined contiguously in the material band.

3. The process as in claim 1, further comprising thread binding the edges of the roller blind devices in the material band prior to separating the individual devices along the separating strips.

4. The process as in claim 1, further comprising reinforcing the edges of the roller blind devices in the material band prior to separating the individual devices along the separating strips.

5. The process as in claim 4, wherein said reinforcing comprising working in a thread having a lower melting point along the edges such that subsequent heating of the edges causes the lower melting point thread to melt and seal the edges.

6. The process as in claim 1, further comprising providing a separating row in the material band between each of the roller blind devices and the respective longitudinal edge areas.

7. The process as in claim 1, further comprising defining the separating strips in the material band with a dissolvable thread.

8. The process as in claim 1, further comprising defining a tubular pocket in the material band along at least one edge of the devices, the tubular pocket configured for receipt of a rod member.

9. The process as in claim 1, further comprising providing eyelets in one of the edges of the devices for subsequent fastening of retaining devices.

10. The process as in claim 1, further comprising defining fastening ribbons in the material band along at least one of the edges of the devices.

11. The process of claim 1, further comprising providing a woven material band.

12. The process as in claim 11, wherein said defining the shapes of the devices further comprises patterning the shape into the material.

13. The process as in claim 11, further comprising laying a reinforcing weft thread in the material band along at least one of the edges of the devices.

14. The process of claim 2 further comprising providing a woven material band.

15. The process as in claim 14, further comprising defining the separating strips by thickening warp threads in a desired location, the thickened warp threads capable of being subsequently pulled from the material band to separate the devices.

16. A process for producing roller blind devices, comprising: providing a continuous material band having a uniform width defining a plurality of shapes for a plurality of individual roller blind devices in said continuous material band having a uniform width by defining edges of the devices between longitudinal edge areas of the material band; providing separating strips in the material band between adjacent edges of the roller blind devices; defining a tubular pocket in the material band along at least one edge of the roller blind devices; and, removing the individual roller blind devices from the continuous material band.

17. The process as in claim 16, further comprising separating the material band along the separating strips after defining the tubular pockets.

18. The process as in claim 16, further comprising defining the tubular pockets with a curvature.

19. The process as in claim 16, further comprising defining a safety edge between the tubular pockets and their respective edge.

20. The process as in claim 16, further comprising heat pressing the material band at least in the area of the tubular pockets.

21. The process as in claim 16, comprising making the material band from one of a thread material and textured yarn at least in the area of the tubular pockets.

22. The process as in claim 21, comprising defining the tubular pockets out of warp threads of the material band without weft yarn inclusions.

23. The process as in claim 22, further comprising providing interruptions along the tubular pockets.

24. The process as in claim 16, further comprising inserting a rod into the tubular pockets, the rod having a cavity defined along the length thereof, and fastening the rod within the tubular pocket by drawing a portion of the tubular pocket into the cavity structure.

25. The process as in claim 24, further comprising inserting an elastic safety part into the cavity structure.

26. The process as in claim 25, further comprising expanding the safety part into the cavity structure by inserting a body into a central recess of the safety part.

* * * * *